United States Patent [19]

Colle et al.

[11] Patent Number: 4,765,259

[45] Date of Patent: Aug. 23, 1988

[54] SODIUM ADDITION TO LOW RANK COAL TO ENHANCE PARTICULATE REMOVAL FROM COMBUSTION EFFLUENT

[75] Inventors: Thomas H. Colle; Ashok K. Moza, both of Houston, Tex.

[73] Assignee: Exxon Research and Engineering Company, Florham Park, N.J.

[21] Appl. No.: 75,429

[22] Filed: Jul. 20, 1987

[51] Int. Cl.[4] ..... F23B 7/00

[52] U.S. Cl. ..... 110/342; 44/620; 44/641; 110/216; 110/345

[58] Field of Search ..... 110/342, 343, 344, 216; 44/4, 5

[56] References Cited

U.S. PATENT DOCUMENTS

| | | | |
|---|---|---|---|
| Re. 17,566 | 1/1930 | Belknap . | |
| 737,023 | 8/1903 | Rockwell . | |
| 896,875 | 8/1908 | Williams | 44/4 |
| 2,162,221 | 6/1939 | Kasehagen . | |
| 3,540,387 | 11/1970 | McLaren . | |
| 4,092,125 | 5/1978 | Stambaugh . | |
| 4,148,613 | 4/1979 | Myers . | |
| 4,159,683 | 7/1979 | Hughes et al. | 110/343 |
| 4,222,849 | 9/1980 | Shimizu . | |
| 4,234,319 | 11/1980 | Beeson . | |
| 4,551,155 | 11/1985 | Wood . | |

FOREIGN PATENT DOCUMENTS

| | | | |
|---|---|---|---|
| 795919 | 1/1936 | France | 110/343 |
| 116676 | 6/1918 | United Kingdom | 44/4 |

*Primary Examiner*—Edward G. Favors

*Attorney, Agent, or Firm*—Joseph J. Dvorak

[57] ABSTRACT

The present invention provides a method for rendering coal more suitable for combustion in systems having electrostatic precipitators for removal of particulates from effluent combustion gas streams, which comprises contacting the coal with an aqueous solution of a sodium compound for a time sufficient to permit the sodium in said solution to react with the coal.

9 Claims, 1 Drawing Sheet

SODIUM ADDITION TO LOW RANK COAL TO ENHANCE PARTICULATE REMOVAL FROM COMBUSTION EFFLUENT

FIELD OF THE INVENTION

This invention relates to the pretreatment of low rank coal for the purpose of enhancing the removal of particulates in gaseous effluents generated upon combustion of the coal.

BACKGROUND OF THE INVENTION

Large amounts of low rank coals, i.e. sub-bituminous coal, lignite and peat, from the Western United States are burned for electricity generation. Inorganic material contained in this coal produces particulate matter, such as fly ash, during its combustion. The fly ash, of course, is entrained in the gaseous effluent stream. Prior to emission of the effluent stream with the atmosphere, the particulate content must be reduced to meet quantitative requirements regarding the amount of particulates (pounds particulates/million Btu of coal) and the appearance of the stack plume (opacity). Fly ash typically is removed from coal combustion effluent streams by means of electrostatic precipitators. These are large and expensive pieces of equipment, the performance of which is affected by a number of factors including the electrical resistivity of the ash, the particle size, gas velocity through the precipitators, the size of the precipitator, physical condition and the like.

Typically, in coal fired utility plants the electrostatic precipitator is located either between the furnace and the air preheater, or between the air preheater and the inducted draft fan. In the former case, gas temperatures are generally between about 600° F. to about 800° F. and in the latter case, gas temperatures are between about 300° F. to about 400° F. Hence, the former precipitators are referred to as hot side precipitators, and the latter, cold side precipitators.

The low sulfur-containing coals, e.g. coals having less than about 2 weight percent sulfur, typically burned today produce a fly ash that has a higher resistivity at gas temperatures in the 300° F. to 400° F. range than the resistivity of fly ash from high sulfur coals. To satisfactorily remove that fly ash from utility plant effluent gas streams with a cold side precipitator requires a substantially larger and more expensive electrostatic precipitator than that required for high sulfur coals. At temperatures in the 600° F. to 800° F. range, however, the low sulfur coal produces a fly ash with a significantly lower resistivity, thereby decreasing the effective size and cost of the precipitator required.

The performance experience of hot side electrostatic precipitators with low rank coals often has not been as good as expected. At times the quantitative requirements on pounds particulate/million Btu have been difficult to maintain. Other times, the requirements on the quantity of particulates were easily satisfied, but opacity of the effluent was difficult to maintain at a low level. The latter performance experience has often been attributed to the low sodium content, i.e., less than about 2 weight percent $Na_2O$ on ash, of some low rank coals. It is commonly believed, for example, that alkalis, such as sodium or potassium, strongly influence the resistivity of the fly ash. The higher the sodium content of the coal, the greater the ease of removal of the ash by electrostatic precipitators. Therefore, coals with a relatively low sodium content, for example, in the range of 0.5 to 2 weight percent $Na_2O$ on ash, are commonly treated with dry sodium carbonate or other solid sodium-containing compounds prior to combustion to improve the operation of the hot side electrostatic precipitator. This treatment, unfortunately, is only partially effective in most cases. Additionally, excess sodium can result in severe slagging problems in the boiler. Also, most of the sodium carbonate added evaporates in the furnace and condenses on heat transfer surfaces. Thus, there remains a need for enhancing the ability of electrostatic precipitators to successfully remove particulates from gas streams generated during combustion of coal.

SUMMARY OF THE INVENTION

It has now been discovered that the pretreatment of low rank coal with aqueous solutions of sodium compounds, such as sodium hydroxide, is effective in increasing the sodium content and particle size of the fly ash when the coal is combusted, thereby rendering the ash more readily removable from the combustion effluent gas stream by electrostatic precipitators. Thus, in one embodiment of the present invention a method is provided for rendering coal more suitable for combustion in systems having electrostatic precipitators for removal of particulates from effluent combustion gas streams, which comprises contacting the coal with an aqueous solution of a sodium compound for a time sufficient to permit the sodium in said solution to react with the coal.

In the practice of the present invention, it is particularly preferred that the sodium compound used for contacting the coal is sodium hydroxide.

Other important features of the present invention will be readily apparent upon the reading of the "Detailed Description" which follows in conjunction with the Drawings.

DETAILED DESCRIPTION OF THE INVENTION

Figure 1:
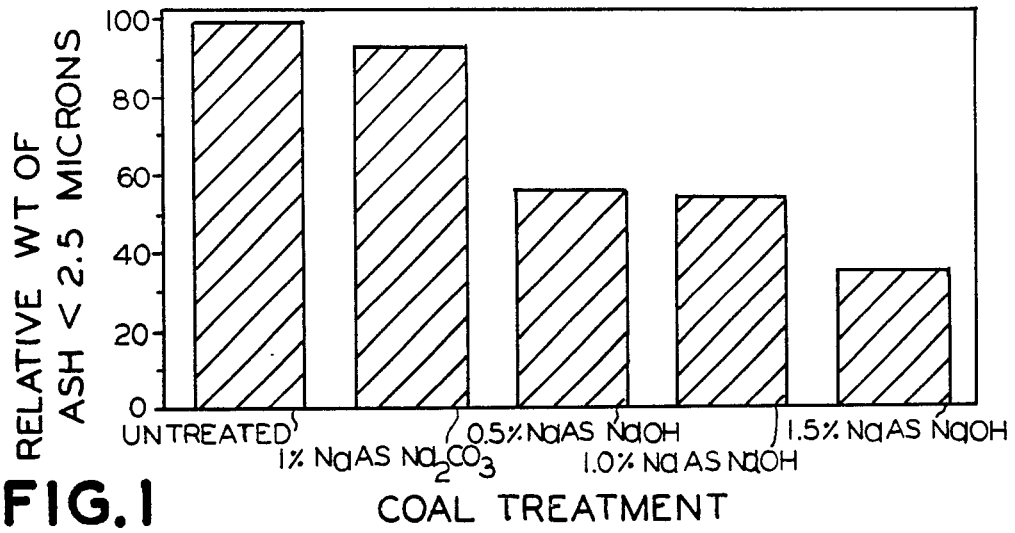
FIG. 1 graphically illustrates the fly ash size reduction achieved by practice of the present invention.

In the combustion of coal and, particularly, in the combustion of low rank coal such as sub-bituminous coal, lignite and peat, the gases of combustion bear an inorganic particulate material, commonly referred to as fly ash. Environmental regulations restrict the amount of fly ash that can be emitted from effluent gaseous streams into the atmosphere. This amount is measured both by the actual pounds of fly ash released and by the visual appearance or opacity of the stack plume.

To reduce the amount of fly ash emitted into the atmosphere during coal combustion in a pulverized coal furnace, the ash typically is collected or removed from the gaseous effluent with electrostatic precipitators. Electrostatic precitators located and designed to operate at about 600° to about 800° F. are called hot side electrostatic precipitators and those located and designed to operate at about 300° to 400° F. are called cold side electrostatic precipitators. The present invention is particularly concerned with separating fly ash from coal combustion effluent gas streams with hot side electrostatic precipitators although benefits also will accrue to the practice of the present invention in connection with cold side electrostatic precipitators.

In accordance with the method of the present invention, low rank coal and, especially, sub-bituminous coal is rendered more suitable for combustion by first contacting the coal with an aqueous solution containing sodium compounds. Suitable sodium-containing compounds include sodium hydroxide, sodium chloride, sodium carbonate, sodium bicarbonate, sodium sulfate, sodium nitrate, sodium phosphate, and sodium bisulfate. Preferably, the sodium compound used is a basic compound.

The precise amount of sodium compound used in the aqueous solution is not critical, and will depend, of course, on a number of factors, including the nature of the coal itself and the specific sodium compound that is employed. In general, however, the aqueous sodium-containing solution will contain from about 1 weight percent to about 70 weight percent sodium.

The ratio of sodium compound to coal employed also is not critical and will vary depending upon the composition of the coal and the sodium compound used. In general, however, sufficient sodium to coal is used to increase the sodium content of the ash produced on combustion from about 0.3 weight percent to about 2 weight percent over that in the ash in the absence of treatment of the coal in accordance with the method of this invention. Stated differently, the amount of sodium to coal used should be that sufficient to provide an ash on combustion that contains from about 1.5 weight percent to about 3.0 weight $Na_2O$ on ash.

In the practice of the present invention, it is particularly preferred to use aqueous solutions of sodium hydroxide.

The contacting of the coal with the aqueous solution of a sodium compound can be conducted in a wide variety of ways. The most simple and preferable way of contacting the coal with the aqueous solution is to spray the coal with the solution. This, of course, can be achieved at the coal mine or at the facility utilizing the coal in combustion.

In general, the contacting should be for a time sufficient to permit the sodium to react with the coal. This time will vary, of course, depending upon the nature of the sodium compound employed. In general, however, contact times will be on the order of several minutes or less. Indeed, contact times of greater than about 1 minute in some instances may be undesirable. A simple screening test for determining contact time is to slurry a coal sample with water and measure the sodium content of the aqueous phase over time. The point at which the sodium content is the lowest would be suitable consistent with other practical considerations. In the case of when aqueous sodium hydroxide is employed, for example, the coal can be combusted almost immediately after spraying of the coal with the sodium solution is completed.

The following data will serve to illustrate the present invention.

Table A presents data obtained on ash samples collected at a coal-powered electric utility combusting a sub-bituminous coal during a period when the opacity requirement was being exceeded. The data shows that the ash leaving the stack in the effluent gas consists mostly of fine calcium oxide particles, and it is very low in sodium content.

TABLE A

| Point of Collection | Wt % Particles Less Than 1.0 | Wt % Particles Less Than 0.5 | Chemical Analyses CaO | Chemical Analyses $Na_2O$ | % Particles Analyzed as 100% CaO |
|---|---|---|---|---|---|
| Stack | 88 | 51 | 39 | 0.8 | 48 |
| ESP Hoppers | 12 | 8 | 27 | 1.3 | 12 |

Table B presents data establishing the remarkable effect that pretreatment of the coal with an aqueous sodium hydroxide solution has on increasing the sodium content of the ash. In these experiments, a drop tube furnace was employed in generating the data.

The furnace is oriented vertically and has a heated section approximately four feet long and is electrically heated to 1300° C. to approximate the temperature encountered in a pulverized coal furnace. For these experiments Caballo coal was ground to about the same fineness used in utility furnaces or 70 weight percent passing through a 200 mesh screen. The ground coal is introduced at the top of the drop tube furnace along with a 20 percent stoichiometric excess of air (also typical of commercial conditions). The air and coal feed rate are sized such that the particle residence time in the drop tube furnace is about two seconds, comparable to residence times in the radiant section of utility boilers. The coal particles burn as they fall in the drop tube furnace and the resultant ash is collected on a sintered metal grid at the bottom of the tube. The collected ash was then analyzed to yield compositional and size distribution data as shown in Table B.

For the experiments in Table B samples of coal were treated with the appropriate amount of approximately 1 weight percent NaOH solutions or thoroughly mixed with dry reagent grade $Na2CO_3$ to add the amount of sodium shown in the Table. The sodium hydroxide solution was used at a 1 weight percent concentration to facilitate treating small samples of coal. After stirring the coal and sodium hydroxide solution, the treated coal was dried to remove the added moisture.

TABLE B

| % Na on Ash Added to Coal | Dry $Na_2CO_3$ Addition: % $Na_2O$ in Ash | Dry $Na_2CO_3$ Addition: Wt % Ash Particles <1 Micron | Wet NaOH Addition: % $Na_2O$ in Ash | Wet NaOH Addition: Wt % Ash Particles <1 Micron |
|---|---|---|---|---|
| 0.0 | 1.0 | 18 | 1.0 | 18 |
| 0.5 | 1.1 | 17 | 1.4 | 12 |
| 1.0 | 1.1 | 16 | 1.8 | 6 |
| 2.0 | 1.2 | 16 | 2.5 | 5 |

Table C shows the results of treating one-half inch coal samples with sodium chloride solution and with sodium hydroxide solution having sufficient sodium in the solution to provide the equivalent of 1 weight percent sodium on ash.

This data with Caballo coal was obtaine by mixing 3 pound samples of the coal with 3,000 cc's of a solution containing enough sodium to equal 1 weight percent $Na_2O$ on ash. The mixture was stirred and at different times a sample of the liquid was remove and filtered. The filtered liquid was then analyzed with an Orion specific ion meter using a sodiumsensitive electrode which measures the concentration of sodium in a solution. The difference between the original sodium in solution and the sodium concentration at any given time gives an indication of how much sodium has chemically reacted with the coal. In similar experiments using pure water, it was found that over time sodium is leached from the coal. Consequently, the numbers in parentheses in Table C are corrected for this leaching effect.

TABLE C

| Time | % Sodium Reacted with Coal | |
|---|---|---|
| | NaCl Solution | NaOH Solution |
| 1 minute | 13 | 98 (99) |
| 5 minutes | 23 | 96 (98) |
| 30 minutes | 26 | 93 (96) |
| 60 minutes | 28 | 88 (92) |
| 4 hours | 29 | 84 (93) |
| 24 hours | 26 | 75 (93) |

In any event, as can be seen, the sodium hydroxide is much more reactive than the sodium chloride.

As a further illustration of the embodiments of the present invention, the following example is given for illustrative purposes.

EXAMPLE

A series of runs were carried out to show the effectiveness of pretreating coal with an aqueous sodium solution prior to combustion so as to enhance the ability to remove fly ash from the combustion air stream. In these runs 400-pound batches of sub-bituminous coal were employed. One batch was untreated, one batch was treated with dry sodium carbonate and three batches were treated with various amounts of sodium hydroxide, as is shown in Table D.

TABLE D

| Run | Added $Na_2O$ Wt % Ash | Total $Na_2O$ Wt % Ash | Wt % Ash | BTU/ Lb | Added $H_2O$, Wt % |
|---|---|---|---|---|---|
| 1 | None | 1.1 | 7.34 | 8018 | 1.0 |
| 2 | 1.0% as $Na_2CO_3$ | 1.8 | 7.53 | 7954 | None |
| 3 | 0.5% as NaOH | 1.4 | 6.67 | 8218 | 1.0 |
| 4 | 1.0% as NaOH | 1.8 | 6.88 | 8394 | 1.0 |
| 5 | 1.5% as NaOH | 2.2 | 6.59 | 8055 | 1.0 |

Figure 2:
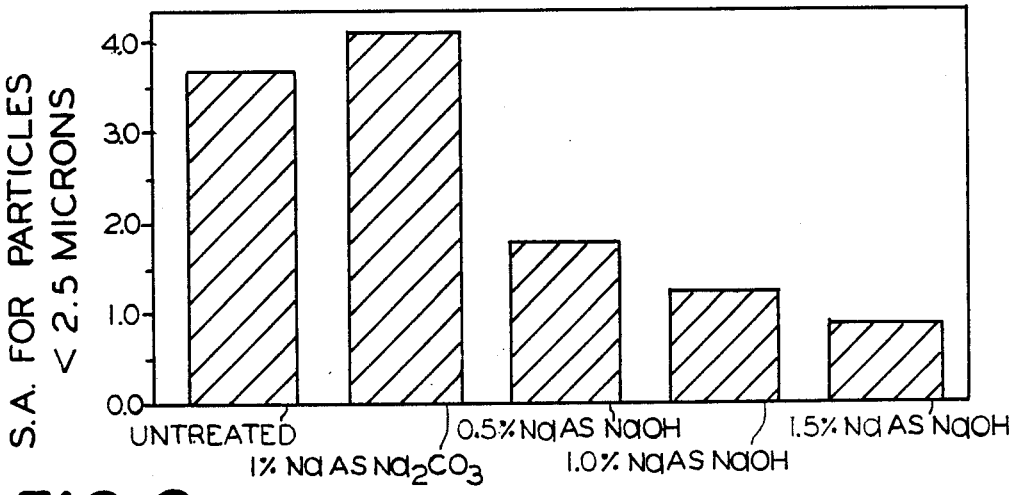
FIG. 2 graphically illustrates the fly ash surface area reduction achieved by practice of the present invention.
Figure 3:
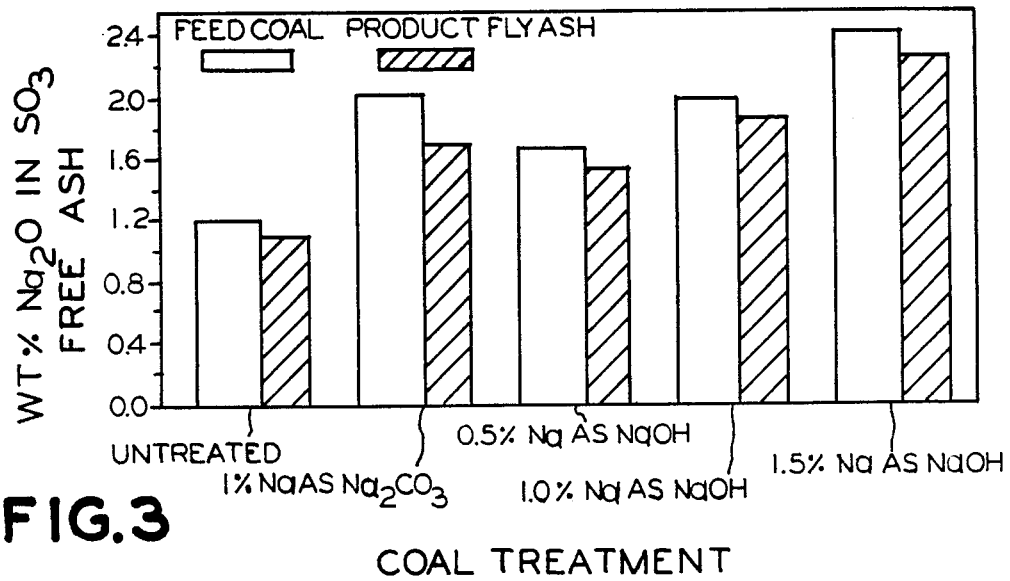
FIG. 3 graphically illustrates the increase in sodium on fly ash achieved by the practice of the present invention.

These samples were combusted in a furnace provided with air/water cooling to control the temperature profile in the furnace. The ash samples were collected in these tests at hot side electrostatic precipitator conditions. Analysis of the ash collected is shown in FIGS. 1 to 3.

As can be seen from FIG. 1, use of aqueous sodium hydroxide reduces the amount of fine fly ash more than use of dry sodium carbonate. Additionally, as is shown in FIG. 2, use of aqueous sodium hydroxide reduces the surface area of the fly ash more than use of dry sodium carbonate. It should be appreciated that the higher the surface area, the greater the opacity of the stack plume. FIG. 3 additionally shows that more of the added sodium ends up on the product fly ash when sodium is added to coal as the aqueous hydroxide rather than as dry sodium carbonate.

As these tests demonstrate, the use of aqueous sodium compounds, such as aqueous sodium hydroxide, reduces the amount of very fine fly ash up to 65 percent compared to untreated coal or coal treated with dry sodium carbonate. Additionally, use of aqueous sodium hydroxide reduces the cumulative surface area greater than the reduction in weight of fine fly ash. Importantly, use of aqueous sodium hydroxide is more effective in increasing the $Na_2O$ level of fly ash than dry sodium carbonate and, hence, enhances the ability of the fly ash to be removed in electrostatic precipitators.

These and other advantages of the process of the present invention should be readily apparent to those skilled in the art. Various changes and modifications of the invention disclosed herein may be made without departing from the spirit and scope of the invention.

What is claimed is:

1. A method of preparing coal for combustion in order to increase the particle size of fly ash generated thereupon to enhance the ability to remove the ash from combustion gases, said method comprising contacting said coal with an aqueous solution of a sodium compound in an amount and for a time sufficient to increase the amount of sodium contained in the fly ash when said coal is combusted from about 0.3 percent to about 2 percent over untreated coal whereby the particle size of said fly ash is increased and the ability to remove said fly ash from combustion gases is enhanced.

2. The method of claim 1 wherein said sodium compound is present in said solution in amounts ranging from between 1 to 70 weight percent.

3. The method of claim 2 wherein said sodium compound is sodium hydroxide.

4. The method of claim 3 wherein said coal is contacted for about 1 minute.

5. The method of claim 5 wherein said contacting is conducted by spraying said coal with said aqueous solution.

6. The method of claim 1 wherein said coal is contacted with sufficient sodium to provide an ash on combustion having from about 1.5 weight percent to about 3.0 weight percent $Na_2O$.

7. The method of claim 6 wherein said aqueous solution is a basic solution.

8. A method for treating coal prior to combustion to increase the sodium content and particle size of fly ash generated during combustion of the coal, thereby improving the removal of the fly ash from combustion gases by electrostatic precipitators, comprising:

spraying the coal with sufficient aqueous solution of a sodium compound to provide a sodium content in the fly ash produced upon combustion in the range of from about 1.5 weight percent to about 3.0 weight percent $Na_2O$ on ash.

9. The method of claim 8 wherein said sodium solution is sodium hydroxide.

* * * * *